US006192897B1

(12) United States Patent
Klebanoff et al.

(10) Patent No.: US 6,192,897 B1
(45) Date of Patent: Feb. 27, 2001

(54) APPARATUS AND METHOD FOR IN-SITU CLEANING OF RESIST OUTGASSING WINDOWS

(75) Inventors: Leonard E. Klebanoff, San Ramon; Steven J. Haney, Tracy, both of CA (US)

(73) Assignee: EUV LLC, Santa Clara, CA (US)

( * ) Notice: Subject to any disclaimer, the term of this patent is extended or adjusted under 35 U.S.C. 154(b) by 0 days.

(21) Appl. No.: 09/238,210

(22) Filed: Jan. 27, 1999

(51) Int. Cl.[7] ..... B08B 7/00; B08B 5/00
(52) U.S. Cl. ..... 134/1.1; 134/1.1; 134/902
(58) Field of Search ..... 134/1, 1.1, 1.2, 134/1.3, 902; 156/345

(56) References Cited

U.S. PATENT DOCUMENTS

| | | | | |
|---|---|---|---|---|
| 5,003,178 | * | 3/1991 | Livesay | 250/492.3 |
| 5,714,306 | * | 2/1998 | Komatsu et al. | 430/323 |
| 5,863,706 | * | 1/1999 | Komatsu et al. | 430/313 |
| 5,932,966 | * | 8/1999 | Schneider et al. | 313/542 |
| 6,031,598 | * | 2/2000 | Tichenor et al. | 355/67 |

* cited by examiner

*Primary Examiner*—Alexander Markoff

(74) *Attorney, Agent, or Firm*—L. E. Carnahan

(57) ABSTRACT

An apparatus and method for in-situ cleaning of resist outgassing windows. The apparatus includes a chamber located in a structure, with the chamber having an outgassing window to be cleaned positioned in alignment with a slot in the chamber, whereby radiation energy passes through the window, the chamber, and the slot onto a resist-coated wafer mounted in the structure. The chamber is connected to a gas supply and the structure is connected to a vacuum pump. Within the chamber are two cylindrical sector electrodes and a filament is electrically connected to one sector electrode and a power supply. In a first cleaning method the sector electrodes are maintained at the same voltage, the filament is unheated, the chamber is filled with argon (Ar) gas under pressure, and the window is maintained at a zero voltage, whereby Ar ions are accelerated onto the window surface, sputtering away carbon deposits that build up as a result of resist outgassing. A second cleaning method is similar except oxygen gas ($O_2$) is admitted to the chamber instead of Ar. These two methods can be carried out during lithographic operation. A third method, carried out during a maintenance period, involves admitting $CO_2$ into the chamber, heating the filament to a point of thermionic emission, the sector electrodes are at different voltages, excited $CO_2$ gas molecules are created which impact the carbon contamination on the window, and gasify it, producing CO gaseous products that are pumped away.

23 Claims, 1 Drawing Sheet

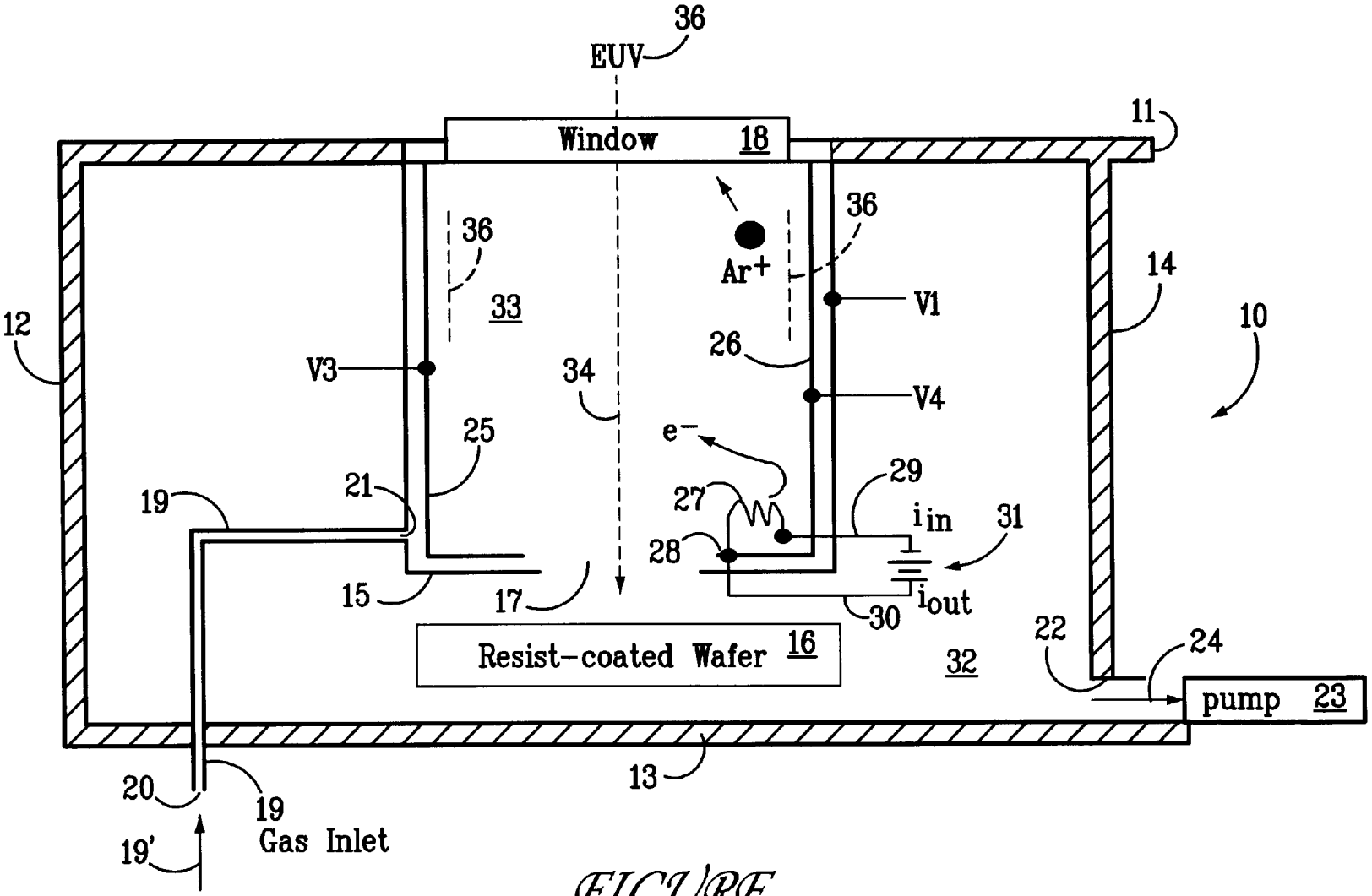
FIGURE

APPARATUS AND METHOD FOR IN-SITU CLEANING OF RESIST OUTGASSING WINDOWS

The United States Government has rights in this invention pursuant to Contract No. DE-AC04-94AL85000 between the United States Department of Energy and the Sandia Corporation for the operation of the Sandia National Laboratories.

BACKGROUND OF THE INVENTION

Field of the Invention

The present invention relates to lithography systems, particularly to removing hydrocarbon contamination emanating from a resist coated wafer under radiation exposure, and more particularly to an apparatus and method for cleaning resist outgassing windows.

In lithography systems involving radiation (photons, electrons) of resist coated wafers, resist outgassing would contaminate lithographic optical components with highly absorbing carbonaceous material, unless such contamination is intercepted. One means for physically intercepting hydrocarbon contamination emanating from a resist coated wafer under radiation exposure is to provide a resist outgassing window which is capable of transmitting the lithographic radiation while physically intercepting the hydrocarbon contamination. The problem associated with the use of resist outgassing windows is that as hydrocarbon contamination from resist outgassing builds up on the window, the window's transmission becomes degraded, eventually to an unacceptable level. This resist-outgassing problem will become more acute with the next generation lithography systems, such as the extreme ultraviolet (EUV), Scattering with Anguler Limitation Projection Electron Lithography (SCALPEL), and the 193 nm lithography systems. Thus, there is a need in the art for an effective means to clean the contamination from the window without physically removing the window from the lithographic tool. An ideal method would continuously clean the window during lithographic operation. A less ideal, but still desirable, method would permit in-situ cleaning of the window in a maintenance period (not during lithographic operation) without removal of the window.

The present invention is directed to a solution of the hydrocarbon contamination problem, and involves an apparatus and method which enables in-situ cleaning of resist outgassing windows during lithographic operation or during a maintenance period without removing the window. The present invention permits removal of hydrocarbon contamination from resist outgassing windows in a highly flexible manner, and is compatible with windows made of any material.

SUMMARY OF THE INVENTION

It is an object of the present invention to prevent contamination of lithographic optical components with highly absorbing carbonaceous material.

A further object of the invention is to physically intercept hydrocarbon contamination emanating from a resist coated wafer under radiation exposure.

A further object of the invention is to provide a resist outgassing window for a lithographic system that can be cleaned without removal.

Another object of the invention is to provide an apparatus for cleaning hydrocarbon contamination from a resist outgassing window.

Another object of the invention is to provide a method for cleaning resist outgassing windows.

Another object of the invention is to provide a method for removing hydrocarbon contamination from a resist outgassing window during operation or non-operation of the lithographic tool.

Other objects and advantages of the present invention will become apparent from the following description and accompanying drawing. The invention involves an apparatus and method for intercepting hydrocarbon contamination emanating from a resist coated wafer under radiation exposure and for removing the intercepted contamination. The apparatus and method of this invention involves the use of a resist outgassing window located in a chamber having electrodes mounted therein and being supplied with a gas, whereby contamination can be removed from the window during transmission of lithographic radiation therethrough or during time periods of no radiation transmission though the window. The apparatus and method of the present invention is described with respect to cleaning a resist outgassing window for EUV lithography, but the approach can be used for other lithographic systems, such as the next-generation 193 nm and SCALPEL systems. The apparatus, located in a lithographic tool, utilizes a chamber in which the resist outgassing window is mounted on a slot in the chamber opposite the window to enable transmission of radiation through the window, chamber, and onto a resist-coated wafer. The chamber includes spaced electrodes, a filament, and a gas inlet whereby the voltage across the chamber and the gas type in the chamber can be changed or controlled, which enables cleaning of the window to be carried out during operation or non-operation of the lithographic tool without removal of the window. The chamber may be surrounded by conductance-limiting structures that prevent gas transport from the slot in the chamber to the region above the window.

BRIEF DESCRIPTION OF THE DRAWING

The accompanying drawing, which is incorporated into and forms a part of the disclosure illustrates an embodiment of the apparatus of the invention and, together with the description, serves to explain the principles of the invention.

The single figure is a schematic cross-sectional view of an apparatus made in accordance with the present invention which enables various cleaning approaches or methods to be carried out.

DETAILED DESCRIPTION OF THE INVENTION

The present invention is directed to an apparatus and method which enables in-situ cleaning of resist outgassing windows. As pointed out above, in the next generation lithography tools (EUV, SCALPEL, 193 nm), there is a need for a resist outgassing window which can transmit the lithographic radiation (photons, electrons) while physically intercepting hydrocarbon contamination emanating from a resist coated wafer under radiation exposure. The window can also in principle be used to help isolate different vacuum regions of a lithographic tool. As resist outgassing contamination builds up on the window, the window's transmission becomes degraded, and thus cleaning of the window is essential for high efficiency lithographic radiation transmission therethrough. The apparatus and method of this invention enables in-situ cleaning of the window, thus eliminating the necessity of window removal and accompanying lithographic tool downtime. By the present invention the window can be continuously cleaned during lithographic operation or permit in-situ cleaning of the window in a maintenance period (not during lithographic operation), and in view of the flexibility of the cleaning operation, it is compatible with windows made of any material.

The single figure illustrates in cross-section an embodiment of an apparatus for providing in-situ cleaning of a resist outgassing window. While the window in the illustrated apparatus is fixed in a conductance limiting structure, the window could be part of a rotating mechanism that allows a number of windows of the same or different composition to be used and/or cleaned in sequence. As shown the apparatus, located within a lithographic tool, comprises a structure or housing generally indicated at 10 composed of conduction limiting structures or walls 11, 12, 13 and 14 with a window chamber or housing 15 mounted in structure or wall 11 and a resist-coated wafer 16 supported from adjacent structure or wall 13. The conductance-limiting structures or walls 11-14 prevent gas transport from a bottom slot or opening 17 in chamber 15 to the region above a resist outgassing window 18 mounted in the top of chamber 15. A gas inlet indicated at 19 by arrow 19 extends through an opening 20 in structure or wall 13 and terminates in an opening 21 in chamber 15 to establish a gas pressure in the chamber. Structure or wall 14 is provided with an opening 22 connected to a vacuum pump 23 as indicated by arrow 24. Mounted within chamber 15 are two cylindrical sector electrodes 25 and 26, each having a vertical and a horizontal section, with each subtending ~175 degrees (i.e., so they do not touch each other) and spaced a distance slightly greater than the slot 17. The voltages on electrodes 25 and 26 are denoted V3 and V4, respectively. A filament 27 located in chamber 15 is connected at 28 to electrode 26 and to terminals 29 and 30 of a power supply 31 located externally of chamber 15. As shown, the voltage of the filament 27 at point 28 is the same as V4, although this is not essential. Chamber 15 is at a voltage V1, and is connected to a power supply, not shown, as are electrodes 25 and 26. Nominally, V1 could be set for "earth ground" potential, or zero volts. The window 18 is mounted to the top of chamber 15 any way that permits low gas conductance between the chamber 15 and the region above the widow 18. The region 32 within the structure 10 below the slot 17 in chamber 15 is in communication with vacuum pump 23, while the region 33 within chamber 15 is pressurized via gas inlet 19, whereby there can be a pressure differential across the slot 17 of chamber 15. The chamber 15 and electrodes 25 and 26 are fabricated from an electrical conductor or a semiconductor material. The slot 17 acts as a differential pumping slot to allow an elevated gas pressure to be established in region 33 within chamber 15, with a reduced pressure elsewhere, region 32. The flow of gas from the chamber 15 through the slot 17 acts to partially prevent hydrocarbons produced by radiation of resist-coated wafer 16 from entering chamber 15 and subsequently depositing on window 18, while the slot 17 provides unobstructed passage of radiation indicated by arrow 34 from an EUV source 35 transmitted through window 18 onto wafer 16. Also, optional x-y deflecting cylindrical electrode elements 36, shown by dash lines, near window can be utilized to control the angle of incidence of the sputtering ions, thereby fully optimized and controllable sputtering.

The illustrated apparatus allows for at least three separate cleaning methods for removing carbon deposits from the resist outgassing window 18.

Method I: Argon-ion Sputtering

In this method, the filament 27 is not heated, and V3 is adjusted to be the same as V4 (V3=V4). A pressure of ~200 mTorr of Ar is established in the chamber 15. Under EUV operation, ~22 mW of EUV power (@13.4 nm) will be passed by the window 18. The EUV light will ionize Ar atoms in the chamber, producing $Ar^+$. For 22 mW power, 200 mTorr Ar, and a 3" EUV path length through the Ar, there will be generated ~$1\times10^{14}$ Argon ions/sec. In principle, any suitable gas could be used. With V3=V4=~−100 to−500 V and the window maintained at a potential of V1=~0 V, the Ar ions will be accelerated onto the window surface, sputtering away carbon deposits that build up as a result of resist outgassing.

For the EUV power and Ar pressures assumed here, an ion current density of ~0.4 microamps/$cm^2$ will be produced. This current is sufficient to promote sputter cleaning. The Ar pressure and voltages V3 and V4 can be adjusted to attain any desired argon-ion current density and argon-ion energy, and therefore any desired level of sputtering. If desired, the optical x-y deflection electrodes 36 can be used to vary the angle of incidence of the Ar ion beam, providing additional control of the sputtering.

The method can be used continuously, and during EUV wafer exposure (as opposed to during preventative maintenance cycles) to keep carbon contamination from building up on the underside of the window from resist outgassing. The EUV absorption at 13.4 nm for a 3" path length of Ar at 200 mTorr is 6.7%. This would be the EUV transmission price paid for the implementation of in-situ window cleaning concurrent with lithographic operation.

Method II: Oxygen-ion Sputtering

This method is analogous to Method I, only oxygen gas ($O_2$) is admitted to the chamber instead of Ar. Oxygen ions ($O_2^+$) produced by EUV will be accelerated to the window, sputtering away carbon deposits. In addition to the mechanical sputtering, carbon will have a tendency to react with the oxygen ions to produce the gaseous products CO and $CO_2$. Thus, oxygen ion sputtering will promote carbon gasification, which is an additional method for carbon removal from the window surface that complements physical sputtering. The oxygen pressure and voltages V3 and V1 can be adjusted to attain any oxygenion current density and oxygen-ion energy, and therefore any desired level of sputtering and gasification. The method can be used continuously, and during EUV wafer exposure (as opposed to during preventative maintenance cycles) to keep carbon contamination from building up on the underside of the window from resist outgassing.

Method III: Electron-activated $CO_2$ Gasification of Carbon

Method III is used during a preventative maintenance period (i.e., no EUV light in the system). In this method, ~100 mTorr of $CO_2$ is introduced into the chamber 15. The filament 27 is heated to the point of thermionic emission. Since the filament must operate in ~100 mTorr of $CO_2$, the filament should be made from a material that emits electrons at low filament temperature, thereby providing for extended filament lifetime. Such a filament is thoriated iridium (Th-Ir). The voltage V3 is made more positive than V4 by ~25 V. When the filament is heated to the point of thermionic emission, electrons will be accelerated from the filament and towards electrode 25 by 25 V. These electrons will excite $CO_2$ gas molecules in the chamber, creating metastable excited $CO_2$* molecules, as shown by Claxton, et al. (Carbon 1, 495 (1964)). These excited molecules are sufficiently long-lived that they will impact the carbon contamination on the window, and gasify it, producing CO gaseous products that can be pumped away. An electron collection current of 10 mA at electrode 25 will produce enough $CO_2$* to remove C deposits. The probable gasification reaction is:

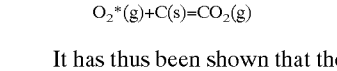

$$CO_2^*(g)+C(s)=2CO(g)$$

The conditions of $CO_2$ pressure and electron current can be continuously adjusted to provide a continuously adjustable cleaning rate. Oxygen could also be used as the electron-activated gas. In this case, the carbon contamination is gasified by metastable $O_2$* molecule, and the reaction would probably be:

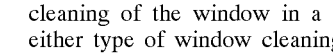

$$O_2^*(g)+C(s)=CO_2(g)$$

It has thus been shown that the present invention provides a solution to the hydrocarbon contamination of resist outgassing windows for lithographic systems. The invention provides an apparatus by which the window may be continuously cleaned during lithographic operation, or in-situ cleaning of the window in a maintenance period. Under either type of window cleaning, the window need not be removed, thus reducing downtime of the lithographic system.

While a specific embodiment of the apparatus has been described and illustrated, along with materials and parameters to exemplify and teach the principles of the invention, such are not intended to be limiting. Modifications and changes may become apparent to those skilled in the art, and it is intended that the invention is to be limited only by the scope of the appended claims.

The invention claimed is:

1. An apparatus for enabling cleaning of a resist outgassing window in a lithographic tool, comprising:

a chamber of electrically conductive material and having an opening at one end, a resist outgassing window mounted in said chamber opposite said opening, at least a pair of spaced electrodes mounted in said chamber, means for supplying a gas into said chamber, means for producing a vacuum external of said chamber, means for applying a potential to said chamber, and means for applying a voltage to said pair of spaced electrodes to create ions from the supplied gas.

2. The apparatus of claim 1, additionally including a filament mounted in said chamber and connected to a power supply.

3. The apparatus of claim 1, wherein said filament is connected to one of said electrodes.

4. The apparatus of claim 1, wherein said pair of spaced electrodes comprise cylindrical sectors.

5. The apparatus of claim 4, wherein said spaced cylindrical sector electrodes subtend about 175 degrees.

6. The apparatus of claim 1, additionally including a pair of spaced x-y deflecting electrodes mounted within said chamber adjacent said window.

7. The apparatus of claim 6, wherein said spaced x-y deflecting electrodes are of cylindrical configuration.

8. The apparatus of claim 1, wherein said chamber is mounted in a conductance limiting structure.

9. The apparatus of claim 1, in combination with a resist-coated wafer mounted external of and adjacent to said opening in said chamber, and a radiation source for directing radiation through said window, said chamber, and said opening onto said resist-coated wafer.

10. A method for cleaning a resist outgassing window, comprising: providing a chamber of conductive material having an opening therein and a resist outgassing window mounted opposite the opening, providing spaced electrodes within the chamber, supplying a gas under pressure into the chamber, applying a voltage to the spaced electrodes, applying a voltage to the chamber different from the voltage to the electrodes, and creating ions from the supplied gas by applying the voltage to the electrodes and chamber causing cleaning of an inner surface of the resist outgassing window.

11. The method of claim 10, additionally including maintaining the electrodes at the same voltage, and wherein supplying a gas under pressure is carried out by supplying a gas selected from the group consisting of argon, oxygen, neon, and krypton.

12. The method of claim 10, additionally including maintaining the electrodes at the same voltage, and wherein supplying a gas under pressure is carried out by supplying an inert gas.

13. The method of claim 11, wherein the electrodes are maintained at a voltage of about −100 to −500 volts, and the chamber is maintained at about 0 volts.

14. The method of claim 11, wherein the gas under pressure is maintained at about 200 mTorr.

15.The method of claim 10, additionally including providing a filament within the chamber, and heating the filament to a point of thermionic emission, and applying a different voltage to each of the spaced electrodes.

16. The method of claim 15, wherein supplying a gas under pressure is carried out by supplying $CO_2$ at about 100 mTorr.

17. The method of claim 15, wherein the filament is fabricated from material selected from the group consisting of thoriated iridium, thoriated indium, tungsten, and molybdenum.

18. The method of claim 15, wherein the filament is fabricated from a thermionic emitter material.

19. The method of claim 15, wherein the voltage applied to the spaced electrodes differs by about 25 volts.

20. The method of claim 15, wherein an electron collection current at one of the spaced electrodes is about 10 mA.

21. The method of claim 15, additionally including electrically connecting the filament to one of the spaced electrodes.

22. The method of claim 10, additionally including forming a pressure differential across the opening in the chamber.

23. The method of claim 10, additionally including providing a conductance limiting structure about the chamber.

* * * * *

UNITED STATES PATENT AND TRADEMARK OFFICE

CERTIFICATE OF CORRECTION

PATENT NO. : 6,192,897 B1
DATED : February 27, 2001
INVENTOR(S) : Klebanoff et al.

It is certified that error appears in the above-identified patent and that said Letters Patent is hereby corrected as shown below:

Column 4,
Line 7, after the words "With V3 = V4 = ~" change "-100 to –500" to "+100 to +500"; and Column 6,
Line 28, after the words "voltage of about", change "-100 to –500" to "+100 to +500".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*